US009951567B2

(12) United States Patent
Cuillier De Maindreville et al.

(10) Patent No.: US 9,951,567 B2
(45) Date of Patent: Apr. 24, 2018

(54) CURVED NOZZLE FOR DRILL BITS

(71) Applicant: Varel Europe S.A.S., Pau (FR)

(72) Inventors: Bruno Cuillier De Maindreville, Pau (FR); Gilles Gallego, Ibos (FR)

(73) Assignee: VAREL EUROPE S.A.S., Pau (FR)

( * ) Notice: Subject to any disclaimer, the term of this patent is extended or adjusted under 35 U.S.C. 154(b) by 224 days.

(21) Appl. No.: 14/485,302

(22) Filed: Sep. 12, 2014

(65) Prior Publication Data

US 2016/0076309 A1 Mar. 17, 2016

(51) Int. Cl.
*E21B 10/61* (2006.01)
*E21B 10/60* (2006.01)

(52) U.S. Cl.
CPC ..... *E21B 10/602* (2013.01); *E21B 10/61* (2013.01)

(58) Field of Classification Search
CPC ..... E21B 10/61; E21B 10/602
See application file for complete search history.

(56) References Cited

U.S. PATENT DOCUMENTS 3,084,751 A * 4/1963 Scarborough ..... E21B 10/18 175/340
4,303,136 A * 12/1981 Ball ..... E21B 10/567 175/393
4,452,324 A * 6/1984 Jurgens ..... E21B 10/567 175/393
4,687,067 A * 8/1987 Smith ..... E21B 10/18 175/340
4,723,612 A 2/1988 Hicks
5,316,095 A * 5/1994 Tibbitts ..... E21B 10/5673 175/429
5,417,296 A * 5/1995 Murdock ..... E21B 10/567 175/393
5,494,122 A * 2/1996 Larsen ..... E21B 10/18 175/340
5,651,421 A * 7/1997 Newton ..... E21B 10/43 175/408
5,785,258 A 7/1998 Akin et al.
5,921,476 A 7/1999 Akin et al.
5,941,461 A 8/1999 Akin et al.
5,992,763 A 11/1999 Smith et al.
6,065,683 A 5/2000 Akin et al.
6,311,793 B1 * 11/2001 Larsen ..... E21B 10/18 175/340
7,802,640 B2 * 9/2010 Gutmark ..... E21B 10/61 175/340
8,047,308 B2 11/2011 Gutmark et al.
8,132,633 B2 3/2012 Cuillier De Maindreville et al.
8,387,724 B2 3/2013 Gutmark et al.
(Continued)

*Primary Examiner* — D. Andrews
*Assistant Examiner* — Ronald R Runyan

(57) ABSTRACT

A curved nozzle for use in a drill bit is disclosed. The curved nozzle includes a flow path that directs drilling fluid towards the face of cutters. The curved nozzle may include a base, neck, and a tip. Flow entering the nozzle, travels along a flow path through the nozzle and out the tip. The flow path may be reduced as it passes through the nozzle. The flow is curved as it flows through the neck and out the tip. The nozzle includes cooperating interior surfaces that guide the flow. The upper interior surface may include two curved zones. The first zone will be a substantially constant radius of curvature. The second zone, extending from the first zone, may be straight.

21 Claims, 10 Drawing Sheets

(56) References Cited

U.S. PATENT DOCUMENTS

| | | | | |
|---|---|---|---|---|
| 2005/0121235 | A1* | 6/2005 | Larsen | E21B 10/18<br>175/340 |
| 2005/0217899 | A1* | 10/2005 | Hossain | E21B 10/18<br>175/340 |
| 2007/0163811 | A1* | 7/2007 | Gutmark | E21B 10/61<br>175/340 |
| 2010/0270086 | A1* | 10/2010 | Matthews | E21B 10/00<br>175/425 |

* cited by examiner

CURVED NOZZLE FOR DRILL BITS

TECHNICAL FIELD

The present invention relates generally to downhole tools used in subterranean drilling, and more particularly, to a curved nozzle used in downhole tools.

BACKGROUND OF THE INVENTION

Drill bits are commonly used for drilling bore holes or wells in earth formations. One type of drill bit is a fixed cutter drill bit which typically includes a plurality of cutting elements, or cutters, disposed within a respective cutter pocket formed within one or more blades of the drill bit and one or more nozzle sockets formed within the drill bit.

FIGS. 1 and 2 show a drill bit 100, or fixed cutter drill bit 100, in accordance with the prior art. Referring to FIG. 1, the drill bit 100 includes a bit body 110 that is coupled to a shank 115 and is designed to rotate in a counter-clockwise direction 190. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string, or other equipment, is positioned on its exterior surface in other exemplary embodiments. A bore (not shown) is formed longitudinally through the shank 115 and extends into the bit body 110 forming a plenum 310 (FIG. 4), which communicates drilling fluid during drilling operations from within the bit body 110 to a drill bit face 111 via one or more nozzle sockets 114 formed within the bit body 110. These nozzle sockets 114 are cylindrically shaped within the drill bit 100.

The bit body 110 includes a plurality of gauge sections 150 and a plurality of blades 130 extending from the drill bit face 111 of the bit body 110 towards the threaded connection 116, where each blade 130 extends to and terminates at a respective gauge section 150. The blade 130 and the respective gauge section 150 are formed as a single component, but are formed separately in certain other drill bits 100. The drill bit face 111 is positioned at one end of the bit body 110 furthest away from the shank 115. The plurality of blades 130 form the cutting surface of the drill bit 100. One or more of these plurality of blades 130 are either coupled to the bit body 110 or are integrally formed with the bit body 110. The gauge sections 150 are positioned at an end of the bit body 110 adjacent the shank 115. The gauge section 150 includes one or more gauge cutters (not shown) in certain drill bits 100. The gauge sections 150 typically define and hold the full hole diameter of the drilled hole. Each of the blades 130 and gauge sections 150 include a leading edge section 152, a face section 154, and a trailing edge section 156. The face section 154 extends from one end of the trailing edge section 156 to an end of the leading edge section 152. The leading edge section 152 faces in the direction of rotation 190. The blades 130 and/or the gauge sections 150 are oriented in a spiral configuration according to some of the prior art. However, in other drill bits, the blades 130 and/or the gauge sections 150 are oriented in a non-spiral configuration. A junk slot 122 is formed, or milled, between each consecutive blade 130, which allows for cuttings and drilling fluid to return to the surface of the wellbore (not shown) once the drilling fluid is discharged from the nozzle sockets 114 during drilling operations.

A plurality of cutters 140 are coupled to each of the blades 130 within a respective cutter pocket 160 formed therein. The cutters 140 are generally formed in an elongated cylindrical shape; however, these cutters 140 can be formed in other shapes, such as disc-shaped or conical-shaped. The cutters 140 typically include a substrate 142, oftentimes cylindrically shaped, and a cutting surface 144, also cylindrically shaped, disposed at one end of the substrate 142 and oriented to extend outwardly from the blade 130 when coupled within the respective cutter pocket 160. The cutting surface 144 can be formed from a hard material, such as bound particles of polycrystalline diamond forming a diamond table, and be disposed on or coupled to a substantially circular profiled end surface of the substrate 142 of each cutter 140. Typically, the polycrystalline diamond cutters ("PDC") are fabricated separately from the bit body 110 and are secured within a respective cutter pocket 160 formed within the bit body 110. Although one type of cutter 140 used within the drill bit 100 is a PDC cutter; other types of cutters also are contemplated as being used within the drill bit 100. These cutters 140 and portions of the bit body 110 deform the earth formation by scraping and/or shearing depending upon the type of drill bit 100.

For steel bits, the nozzle sockets 114 are machined into the drill bit 100. Nozzle sockets are formed using apparatuses and methods known to people having ordinary skill in the art and will not be described in detail herein for the sake of brevity.

FIG. 3A shows a cross-sectional side view a nozzle 210 coupled within the nozzle socket 114 in accordance with the prior art. FIG. 3B shows a top view of the nozzle 210 coupled within the nozzle socket 114 in accordance with the prior art. Referring to FIGS. 3A-3B, the nozzle socket 114 includes a nozzle socket base 230 and a nozzle socket wall 235 extending perpendicularly away from the perimeter of the nozzle socket base 230, thereby forming a cylindrically-shaped cavity 237 therein. Hence, the nozzle socket 114 also is cylindrically shaped. The nozzle 210 is inserted through the nozzle socket 114 and coupled to the bit body 110 (FIG. 1) adjacent the nozzle socket base 230. Although not illustrated, the nozzle 210 is coupled to the bit body 110 (FIG. 1) using a snap-fit, threaded connection, or other method and/or device known to people having ordinary skill in the art.

As previously mentioned, the bore is formed within the shank 115 and extends into the bit body 110 forming the plenum 310. FIG. 4 shows flow paths from the bit 100 to nozzle sockets 114. The bore allows for drilling fluid to flow from within the drill string into the drill bit 100. The flow tubes 320 in the bit body allow drilling fluid to flow from within the plenum 310 to nozzle sockets 114. In the embodiment shown in FIGS. 1 and 2, the fluid reaching the nozzle sockets is sprayed into the well by the nozzles 210. The spray of drilling fluid through the nozzle 210, which are positioned at the drill bit face 111, facilitates removal of the cuttings from the drill bit face 111 and moves them back towards the surface of the ground. The nozzle sockets 114, as previously mentioned, are often cylindrically shaped, i.e., have a nozzle socket wall 235 that forms a cylindrical shape. Although four nozzle sockets 114 are illustrated as being formed within the drill bit 100, greater or fewer nozzle sockets 114 are formed in other drill bits 100.

During drilling of a borehole, the drill bit 100 rotates to cut through an earth formation to form a wellbore therein. This cutting is typically performed through scraping and/or shearing action according to certain drill bits 100, but is performed through other means based upon the type of drill bit used. Drilling fluid (not shown) exits the drill bit 100 through one or more nozzles 210 and facilitates the removal of the cuttings from the borehole wall back towards the surface. As the drill bit 100 rotates and the drilling fluid with cuttings are at the bottom of the borehole, some cuttings adhere to the drill bit 100 causing inefficiencies. Thus, the nozzles 210 facilitate removal of portions of these cutting that are adhered to the drill bit 100.

High angle nozzles, or high angle nozzle sockets, also known as lateral jets, are known in the drill bit casting art. However, they are difficult to incorporate into machined bits, such as steel bits, due to the constraints in the manufacturing process.

BRIEF DESCRIPTION OF THE DRAWINGS

The foregoing and other features and aspects of the invention may be best understood with reference to the following description of certain exemplary embodiments, when read in conjunction with the accompanying drawings, wherein.

The drawings illustrate only exemplary embodiments of the invention and are therefore not to be considered limiting of its scope, as the invention may admit to other equally effective embodiments.

DETAILED DESCRIPTION OF INVENTION

Figure 1:
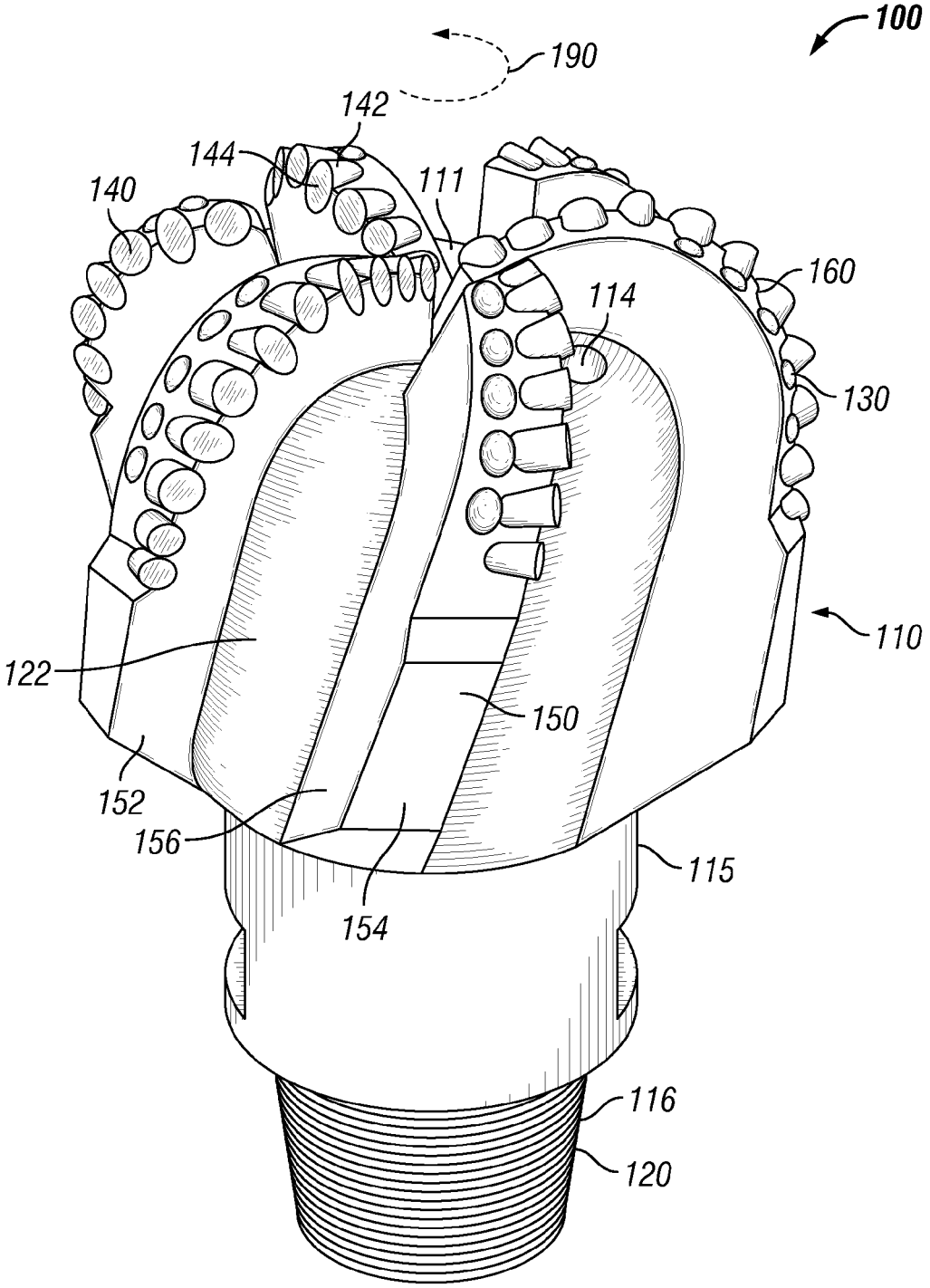
FIG. 1 (Prior Art)
FIG. 1 shows a perspective view of a fixed cutter drill bit in accordance with the prior art.
Figure 2:
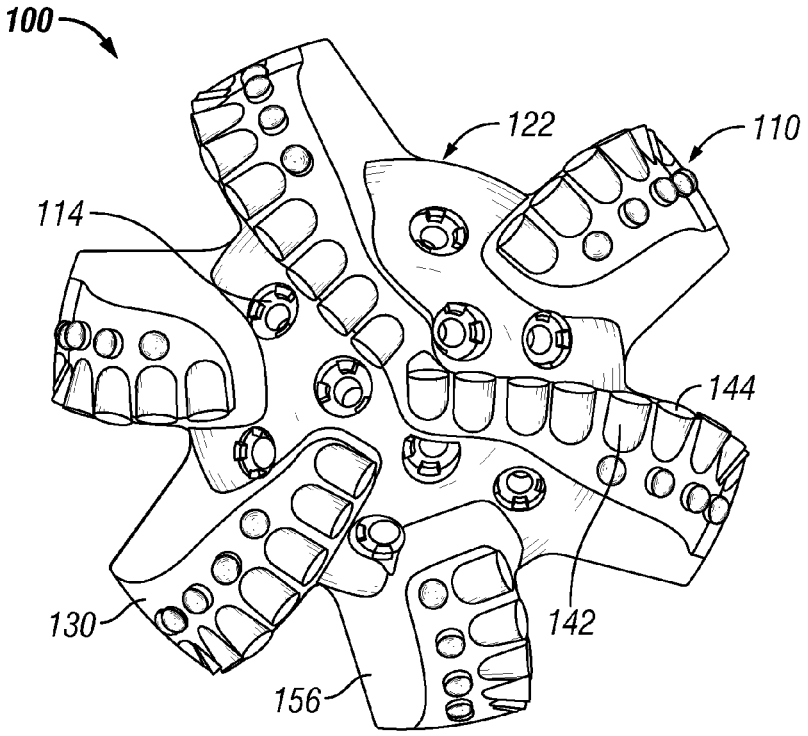
FIG. 2 shows a top view of convention drill bit.
Figure 3A:
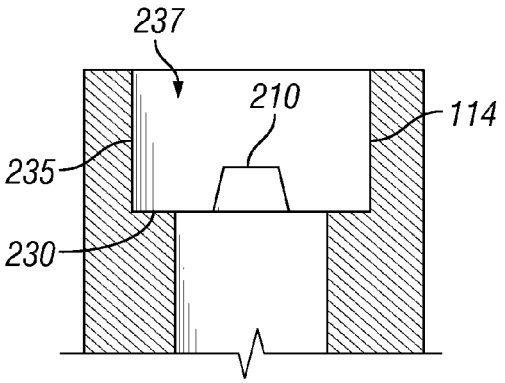
FIG. 3A (Prior Art)
FIG. 3A shows a cross-sectional side view a conventional nozzle positioned within the nozzle socket of FIG. 1 in accordance with the prior art.
Figure 3B:
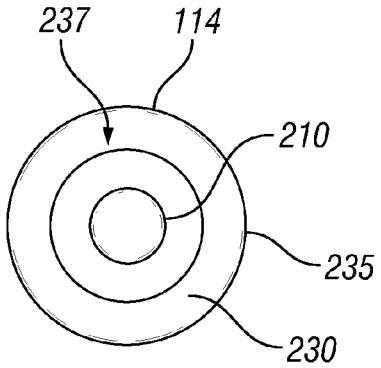
FIG. 3B (Prior Art)
FIG. 3B shows a top view of the conventional nozzle positioned within the nozzle socket of FIG. 1 in accordance with the prior art.
Figure 4:
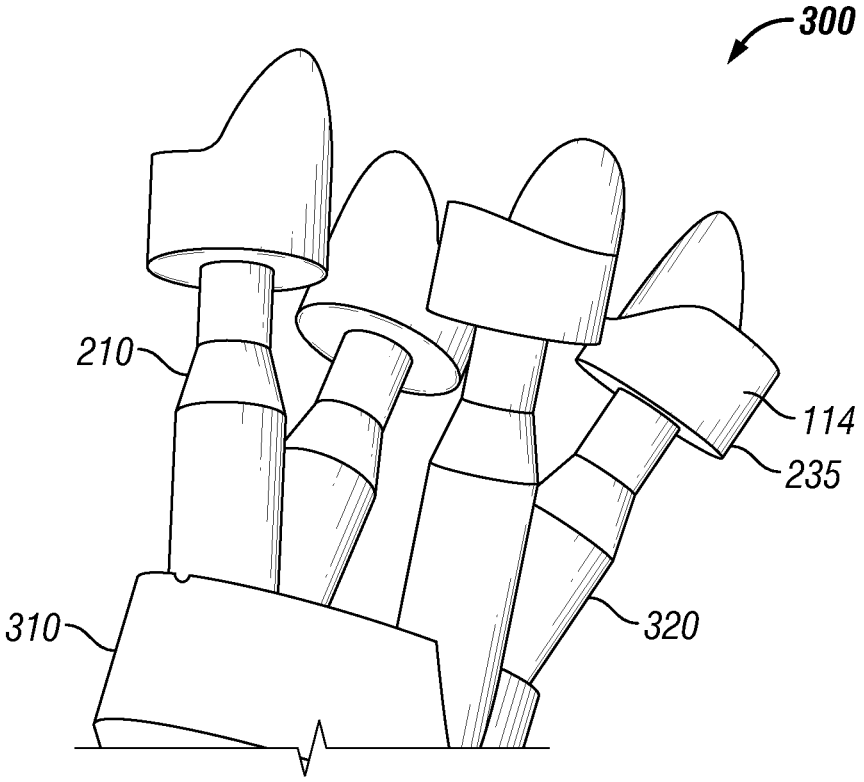
FIG. 4 (Prior Art)
FIG. 4 shows flow paths of an typical bit.

The present invention is directed to downhole tools used in subterranean drilling. In particular, the application is directed to curved nozzles positionable within downhole tools. Although the description of exemplary embodiments is provided below in conjunction with a fixed cutter drill bit, similar to that shown in FIG. 1, alternate exemplary embodiments of the invention may be applicable to other types of downhole tools having nozzle sockets, including, but not limited to, PDC drill bits, roller cone bits, and any other downhole tool that includes one or more nozzle sockets. The present invention may be better understood by reading the following description of non-limiting, exemplary embodiments with reference to the attached drawings, wherein like parts of each of the figures are identified by like reference characters, and which are briefly described as follows.

Figure 5:
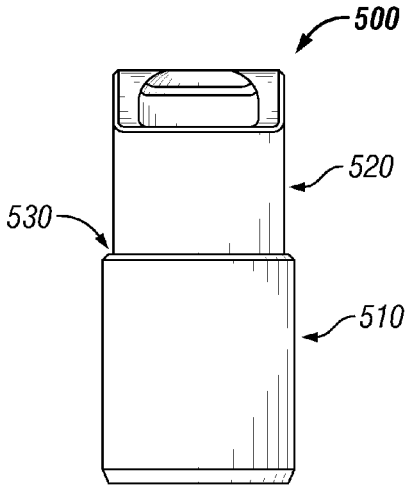
FIG. 5 shows a front view of a curved nozzle.
Figure 6:
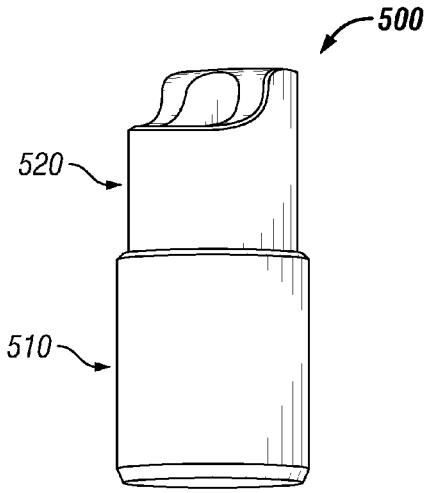
FIG. 6 shows a rotated view of a curved nozzle.

FIGS. 5 and 6 show one embodiment of a curved nozzle 500. Curved nozzle 500 includes a base 510 and neck 520. In one embodiment, the base 510 is sized and shaped to fit within a sleeve retainer 900 (FIG. 9) that secures the curved nozzle 500 into bit 100. In the embodiment of FIGS. 5 and 6, the base 510 is cylindrical and generally smooth. The smoothness of the base 510 facilitates nozzle orientation during installation. For example, curved nozzle 500 can be rotated within sleeve retainer 900 before the sleeve retainer 900 is secured within bit 100. In alternative embodiments, the base 510 can be threaded or otherwise configured so that it can be secured directly into bit 100 without a retaining sleeve. In yet another embodiment, the base 510 of curved nozzle 500 may be indexed so that it fits within a matching shape in bit 100, thereby ensuring a pre-determined orientation. Once positioned, the curved nozzle 500 can be secured in position using a sleeve retainer 900 or other means. The wall thickness of base 510 is suitable for mounting the curved nozzle 500 in bit 100.

In the embodiment shown in FIGS. 5 and 6, neck 520 extends from base 510. The outer diameter of neck 520 is shown as being smaller than the outer diameter of the base 510. However, neck 520 may be the same size or larger than base 510. In the embodiment shown, neck 520 is roughly the same length as base 510. However, the base 510 and neck 520 may be a different length. Alternatively, curved nozzle 500 may not have a neck 520. In the embodiment shown, curved nozzle 500 includes a step 530 at the top of base 510.

Figure 7:
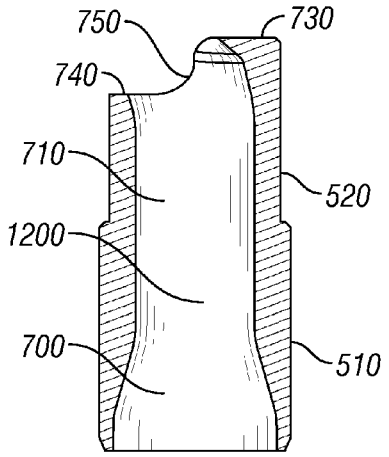
FIG. 7 shows a cut-away, side view of a curved nozzle.

Base 510 and neck 520 are shown as being a single piece. However, base 510 and neck 520 may be separate pieces joined together, either permanently or removably. Further, base 510 and neck 520 can be made of the same or different material. In one embodiment, curved nozzle 500 is made out of sintered tungsten carbide FIG. 7 shows a side, cut-away view of nozzle 500. From FIG. 7, it can be seen that curved nozzle 500 includes a fluid pathway 1200 that connects to flow tube 320. The fluid pathway 1200 includes a transition zone 700, throat 710, and curved tip 720. The transition zone 700 is positioned between the flow tube 320 and the neck 520. In the embodiment shown, the cross sectional area of the transition zone 700 decreases from the cross sectional area of flow tube 320 to the cross sectional area of the throat 710. In a preferred embodiment, the transition is smooth in order to minimize energy loses in the fluid stream, such as losses due to sudden directional changes in the flow path, or configurations that increase flow turbulence. However, the transition zone 710 may be a step or series of small steps. Further, transition zone 710 is shown as being generally symmetrical. However, it may be symmetrical or non-symmetrical.

The throat 710 is the point along the flow path with the smallest cross-sectional area. In the embodiment shown in FIG. 7, the throat 710 includes a length that has a constant cross-sectional area. In other embodiments, however, the throat 710 may be a single point along the length of the nozzle. FIG. 7 shows the transition zone 700 entirely within base 510. However, the transition zone may extend into the neck 520.

The ratio between the cross-sectional area of the flow tube 320 and the cross-sectional area of the throat 710 is determined based in part on fluid supply pressure and the desired flow velocity of the fluid exiting the nozzle 500.

In the embodiment shown, the direction of flow is constant through the flow tubes, base 510 and neck 520 of curved nozzle 500. However, it is understood that some slight directional change from plenum 320 may occur.

Fluid pathway 1200 through curved nozzle 500 extends from the base to the curved tip 720. The curved tip 720 is shaped to angularly deflect flow from the direction it is flowing at the throat 710. In the embodiment shown, curved tip 720 deflects flow approximately 35 degrees. However, other deflection amounts are contemplated.

According to some exemplary embodiment, the curved tip 720 has an upper top surface 730 and lower top surface 740. Shaped region 750 connects the upper and lower top surfaces.

Figure 8:
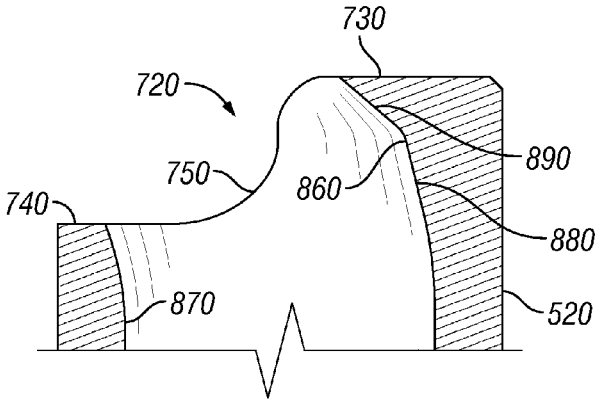
FIG. 8 shows a close-up of a curved nozzle tip.

FIG. 8 shows a close-up of one embodiment of the curved tip 720. The curved tip includes an upper curved surface 860 and lower curved surface 870. According to one embodiment, the upper curved surface 860 includes two distinct curved zones. The first curved zone 880 smoothly transitions from the throat 710 to a second curved zone 890. The second curved zone 890 directs the flow from the first curved zone 880 to the final exit angle. In the embodiment shown in FIG. 8, second curved zone 890 is a straight. However, the second curved zone 890 may be a curved surface. As noted with respect to the embodiment shown, the final exit angle is approximately 35 degrees. The second curved zone 890 is supported by the structure that also forms the upper surface 730. The first curved zone 880 and the lower curved surface 870 may have a similar, but opposite, radius of curvature. In one embodiment, a line extended perpendicular to the point in which the lower curved surface 870 meets the lower top surface 740 intersects the upper curved surface 860 at approximately the point in which the first curved zone 880 transitions into the second curved zone 890.

Although the curved tip of the embodiment shown in FIG. 8 has first and second curved zones (880 and 890), other configurations are contemplated. For example, the directional change from the throat may be smooth, having a constant or near constant radius of curvature. Alternatively, it may have sections with different radii of curvature. Further, instead of a constant radius of curvature, the upper curved surface 860 may include a series of short straight sections that are each angled slightly from the preceding straight section. Still further, the upper curved surface 860 may be combinations of straight and curved sections.

Lower curved surface 870 includes a slight curvature. Like the upper curved surface 860, it may have a single radius of curvature or multiple. Further, instead of a constant radius of curvature, the lower curved surface may include a series of short straight sections that are each angled slightly from the preceding straight section. Still further, the lower curved surface 860 may be combinations of straight and curved sections.

Figure 9:
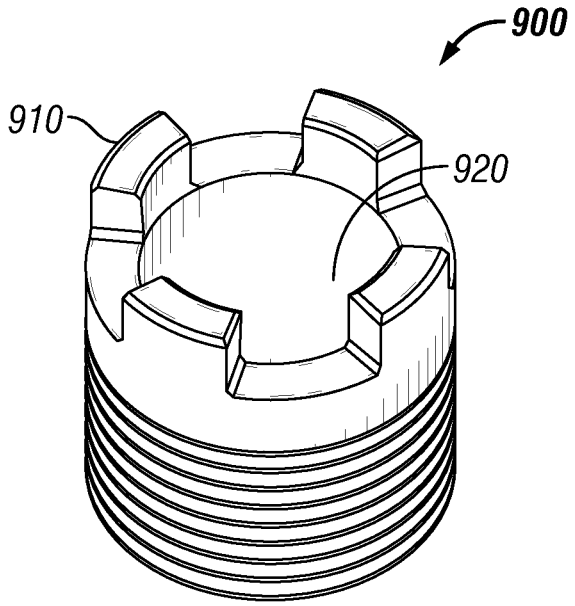
FIG. 9 shows a perspective view a sleeve retainer.

FIG. 9 shows perspective view of sleeve retainer 900. Sleeve retainer 900 is configured to secure nozzle 500 in bit 100. In the embodiment shown, sleeve retainer 900 is threaded to match interior threads in bit 100. However, one skilled in the art understands that other ways of securing sleeve retainer 900 are available.

Sleeve retainer 900 also includes a top edge 910 shaped to assist in installation. For example, a tool can fit within the notches shown to tighten or loosen the sleeve retainer 900.

Figure 10:
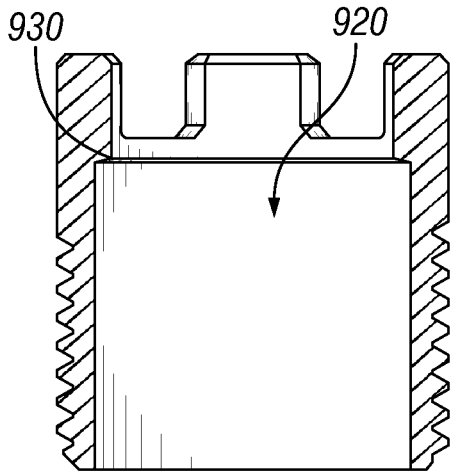
FIG. 10 shows a cut-away view of a sleeve retainer.

FIG. 10 shows a cut-away, side view of sleeve retainer 900. The sleeve retainer 900 has an inner area 920 that is sized and shaped to receive nozzle 500. In one embodiment, inner area 920 is sized and shaped to receive the base 510 of curved nozzle 500. Inner area 920 also includes shoulder 930. The shoulder 930 engages the step 530 between the base 510 and neck 520 of curved nozzle 500. In a preferred embodiment, the shoulder 930 engages step 530 before the sleeve retainer 900 bottoms out in the nozzle socket 114. In this way, the bottom of curved nozzle 500 is pressed firmly against bit 100, or alternatively, against a gasket 1100 between the bottom of curved nozzle 500 and bit 100. In one embodiment, the inner area 920 is sized to have a frictional fit with curved nozzle 500. In this manner, the curved nozzle 500 may be rotated within retainer sleeve 900 prior to retainer sleeve 900 being tightened into its final position. Although a frictional fit is preferred, the inner area 920 and base 510 may be sized for an interference fit or a loose fit.

Figure 11:
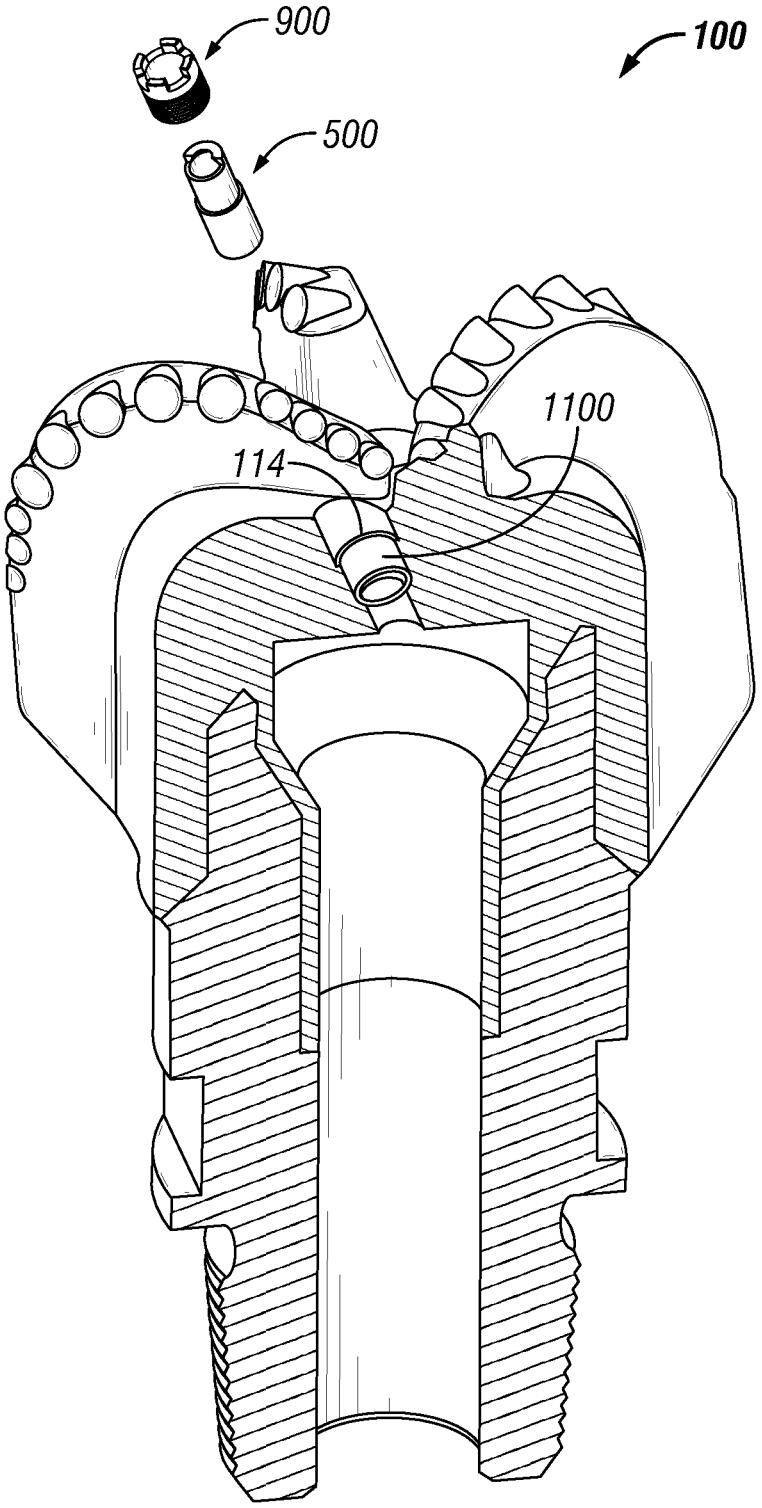
FIG. 11 shows a partial perspective view of the installation of a curved nozzle in a drill bit.

FIG. 11 shows an exploded view of bit 100 showing how curved nozzle 500 is installed. Curved nozzle 500 is positioned on gasket 1100 within nozzle socket 114. In one embodiment, the body and gasket 1100 are made out of the same material. The curved nozzle 500 is oriented as desired. In a preferred embodiment, curved nozzle 500 is positioned to direct fluid along the cutting surfaces 144 of cutters 140 on one blade 130. Once oriented as desired, the sleeve retainer 900 is positioned over the nozzle and tightened to secure the curved nozzle 500 in bit 100. In one embodiment, the threads of sleeve retainer 900 are identical to conventional nozzle threads.

Figure 12A:
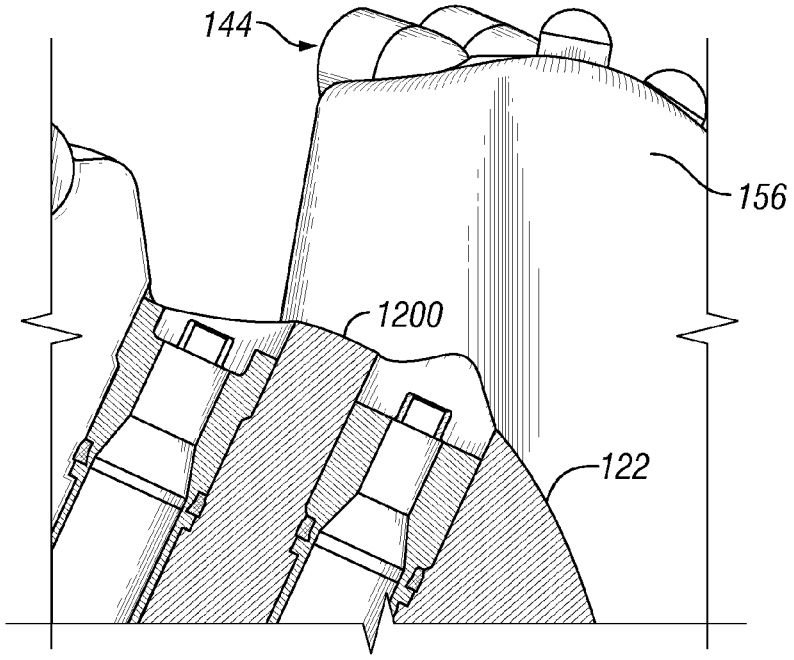
FIG. 12A shows a cut-away view of a drill bit with conventional nozzles.
Figure 12B:
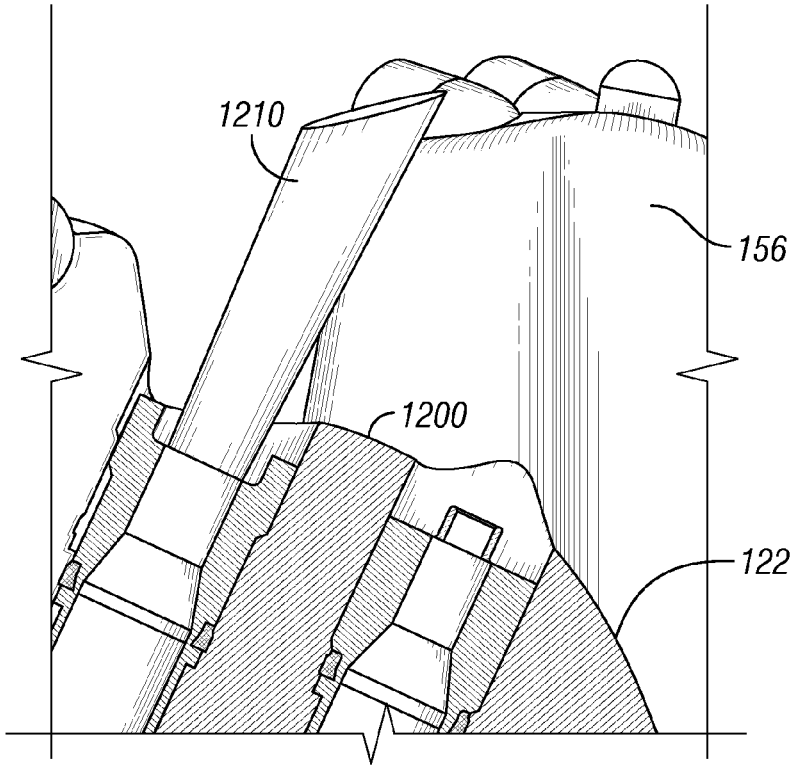
FIG. 12B shows the jet spray from a conventional nozzle.

FIGS. 12A and B show cross sections of bit 100 with conventional nozzles 210. The conventional nozzles 210 are positioned within nozzle socket 114 so that the nozzles do not extend above the water way 1200. FIG. 12B, shows the jet spray pattern 1210 from a conventional nozzle 210. As can be seen, the jet spray pattern 1210 extends in the axial direction of conventional nozzle 210.

Figure 13A:
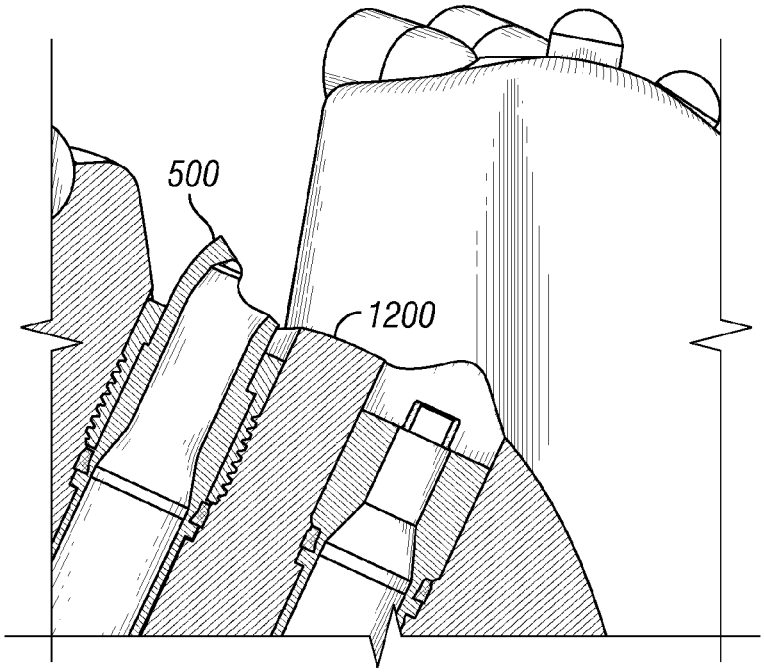
FIG. 13A shows a cut-away view of a drill bit with a curved nozzle.
Figure 13B:
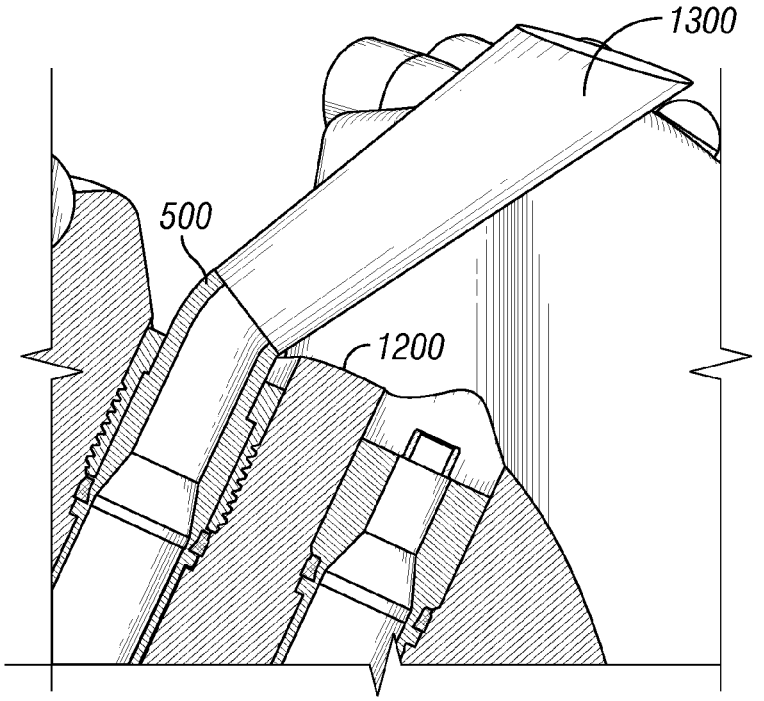
FIG. 13B shows the jet spray from a curved nozzle.

FIGS. 13A and B show cross sections of bit 100 with a curved nozzle 500. In a preferred embodiment, curved nozzle 500 extends into the water way 1200 when installed in bit 100. The jet spray pattern 1300 from curved nozzle 500 extends in the direction established by nozzle tip 720. As noted previously, the jet spray is angled from the flow direction entering the base of curved nozzle 500 by approximately 35 degrees. The curved nozzle 500 is positioned to direct its jet spray away from the axis of the bit 100 and along the cutting surfaces 144 of cutters 140.

Figure 14A:
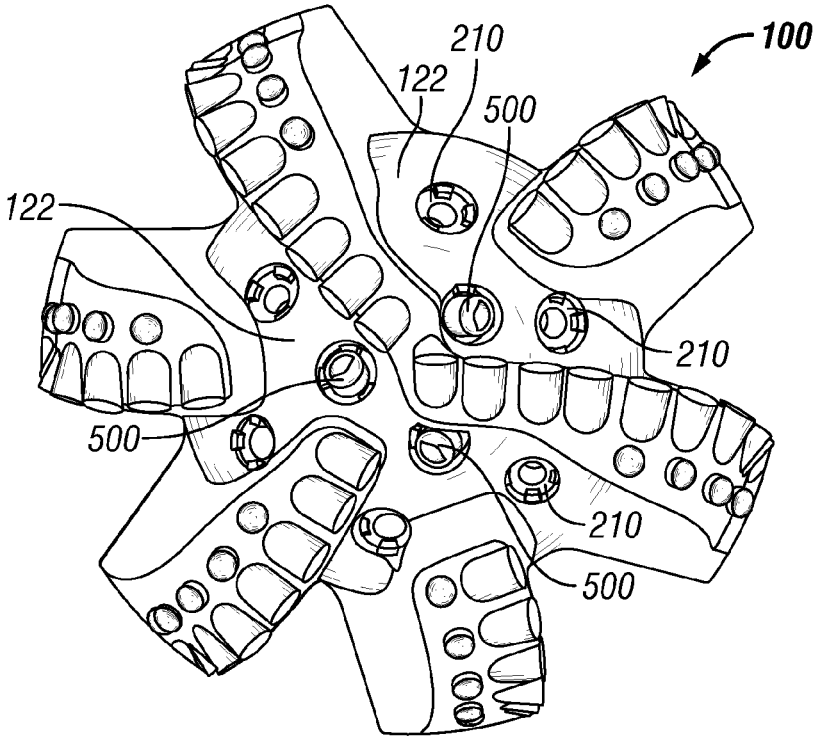
FIG. 14A shows a top view of a drill bit with curved nozzles.

FIG. 14A shows bit 100 with curved nozzles 500 installed. As can also be seen from FIG. 14A, a bit 100 can be configured with both conventional nozzles 210 and curved nozzles 500. In the embodiment shown in FIG. 14A, the inner three nozzles are curved nozzles 500. However, one skilled in the art understands that various combinations are contemplated. For example, a bit 100 may be configured with all curved nozzles 500.

Figure 14B:
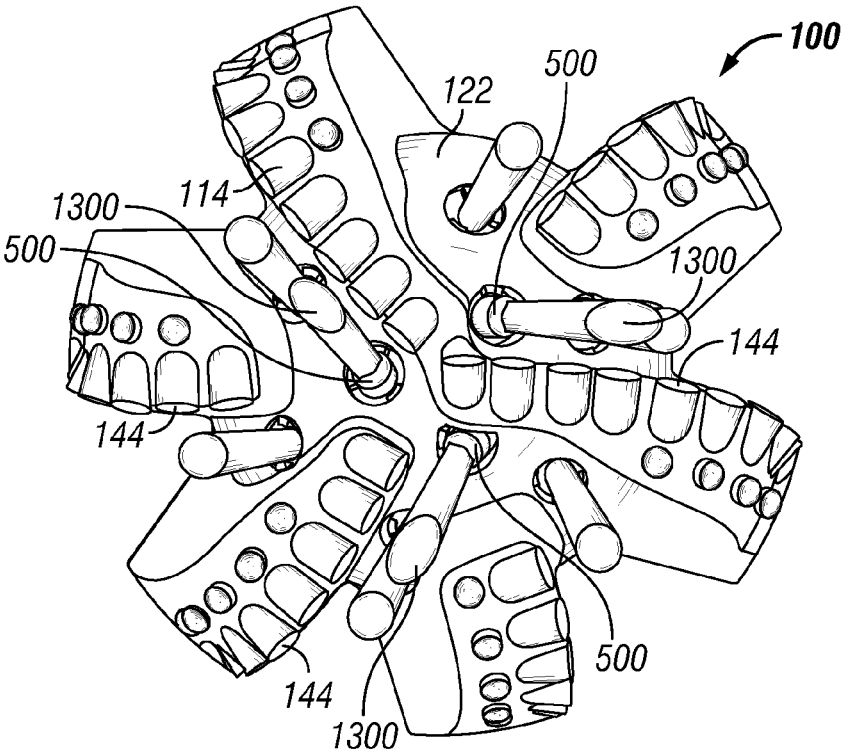
FIGS. 14B and C show jet spray from curved nozzles.
Figure 14C:
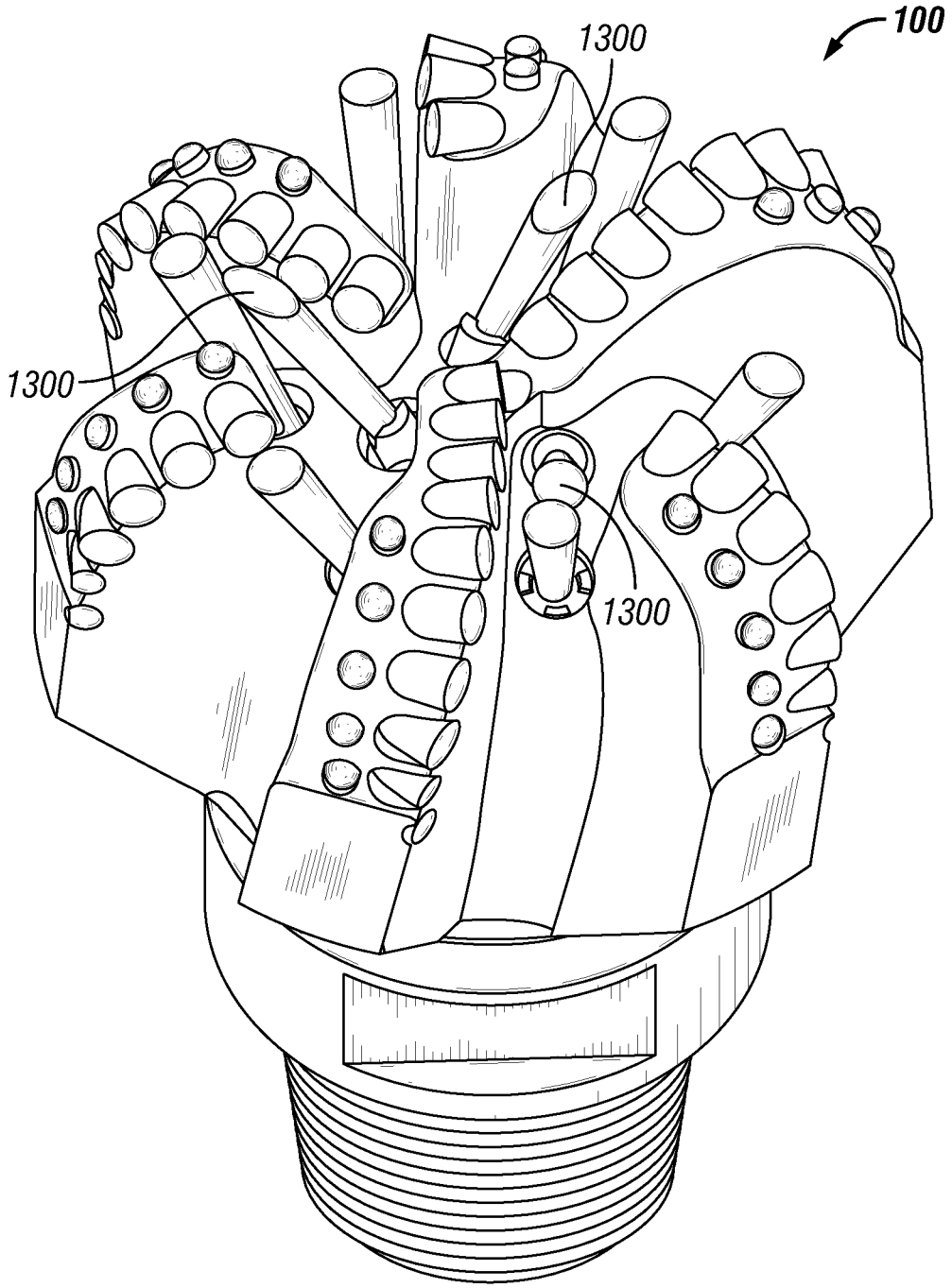

FIGS. 14B and C show views of bit 100 with spray patterns included. Each is oriented to direct its corresponding spray patter 1300 along the cutting surfaces 144 of cutters 114. In this manner, cuttings from the well are more efficiently guided along junk slots 122 and away from the tip of bit 100.

Although each exemplary embodiment has been described in detailed, it is to be construed that any features and modifications that is applicable to one embodiment is also applicable to the other embodiments.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

We claim:

1. A downhole tool, comprising:

a body comprising a plenum and a plurality of flow tubes extending therefrom, said flow tubes each configured to direct fluid flow in a first flow direction;

a plurality of blades extending from a face of the body, each blade having a plurality of cutter pockets formed in a leading edge thereof and each blade extending from a center of the face to a gauge section of the tool;

a plurality of junk slots and water ways defined between the blades;

a plurality of cutters, each cutter disposed within a respective cutter pocket and each cutter including a substrate and a cutting surface; and a plurality of curved nozzles positioned within said body at the face and in the water ways, each curved nozzle in fluid communication with a respective flow tube, wherein:

each curved nozzle includes a base positioned within said body and a neck extending from said base, each curved nozzle further includes a flow path having a transition zone adjacent the respective flow tube, a tip distal from the respective flow tube, and a throat between the transition zone and the tip, each tip has an upper curved surface and a lower curved surface for directing fluid in a second flow direction different from the respective first flow direction, each throat defines a smallest constant cross sectional area of the respective flow path and is located in a straight portion of the respective flow path, each throat extends substantially a length of the neck, each transition zone reduces the cross sectional area of the respective flow path from that of the respective flow tube to that of the respective throat, and each nozzle is made entirely from a carbide material.

2. The downhole tool of claim 1, wherein each second flow direction is angled to direct fluid flow at said respective cutters.

3. The downhole tool of claim 1, wherein each second flow direction is configured to direct a spray pattern that facilitates moving drilling debris along said respective junk slot.

4. The downhole tool of claim 1, wherein each curved nozzle is secured within said body by a sleeve retainer.

5. The downhole tool of claim 4, wherein each base is generally smooth and is configured to mate with said respective sleeve retainer.

6. The downhole tool of claim 5, wherein each curved nozzle includes a step that engages said respective sleeve retainer.

7. The downhole tool of claim 6, wherein each step prevents said respective sleeve retainer from bottoming out in said body.

8. The downhole tool of claim 1, wherein each second flow direction is less than 45 degrees off of said respective first flow direction.

9. The downhole tool of claim 1, wherein:

each tip extends into the respective water way.

10. The downhole tool of claim 9, wherein each upper curved surface comprises a first curved portion and a second straight portion.

11. The downhole tool of claim 10, wherein each first curved portion is a continuous curve.

12. The downhole tool of claim 11, wherein each lower curved surface is a continuous curve.

13. The downhole tool of claim 12, wherein the radius of curvature of each lower curved surface is the same as the radius of curvature of said respective first curved portion.

14. The downhole tool of claim 1, wherein:

each curved nozzle is an inner curved nozzle positioned adjacent a center of the face, and the downhole tool further comprises a plurality of outer straight nozzles positioned within said body distal from the center of the face, and each outer straight nozzle is in fluid communication with a respective flow tube and operable to discharge fluid in the respective first direction.

15. The downhole tool of claim 1, wherein each base is indexed and fits within a respective matching shape of said body, thereby ensuring a predetermined orientation.

16. The downhole tool of claim 1, wherein each tip has a nonplanar end.

17. The downhole tool of claim 16, wherein each nonplanar end has a cross sectional area greater than the cross sectional area of the respective throat.

18. The downhole tool of claim 16, wherein each nonplanar end has a convex portion and a concave portion.

19. The downhole tool of claim 1, wherein each cutting surface is a polycrystalline diamond table.

20. The downhole tool of claim 1, wherein:

the blades and cutters form a cutting face of the downhole tool, and the cutting face is distinct from the face of the body.

21. A downhole tool, comprising:

a body comprising a plenum and a fluid pathway extending therefrom for directing fluid flow in a first flow direction;

a plurality of blades extending from a face of the body, each blade having a plurality of cutter pockets formed in a leading edge thereof and each blade extending from a center of the face to a gauge section of the tool;

a plurality water ways defined between the blades;

a plurality of cutters, each cutter disposed within a respective cutter pocket and each cutter including a substrate and a cutting surface; and a curved nozzle positioned within said body at the face and in one of the water ways, the curved nozzle in fluid communication with the fluid pathway, wherein:

the curved nozzle includes a base positioned within said body and a neck extending from the base and into the one water way, the curved nozzle further includes a flow path having a transition zone adjacent the fluid pathway, a tip distal from the fluid pathway, and a throat between the transition zone and the tip, the tip has a curved surface for directing fluid in a second flow direction different from the first flow direction, the throat defines a smallest constant cross sectional area of the flow path, the throat has a length greater than a length of the tip, and the transition zone reduces the cross sectional area of the flow path from that of the fluid pathway to that of the throat.

* * * * *